US009963886B2

(12) United States Patent
Mitchell

(10) Patent No.: US 9,963,886 B2
(45) Date of Patent: May 8, 2018

(54) HIDDEN BOARD ANCHOR

(71) Applicant: Royal Group, Inc., Atlanta, GA (US)

(72) Inventor: Steven A. Mitchell, Chilhowie, VA (US)

(73) Assignee: Royal Group, Inc., Atlanta, GA (US)

( * ) Notice: Subject to any disclaimer, the term of this patent is extended or adjusted under 35 U.S.C. 154(b) by 0 days. days.

(21) Appl. No.: 15/221,772

(22) Filed: Jul. 28, 2016

(65) Prior Publication Data

US 2017/0037643 A1 Feb. 9, 2017

Related U.S. Application Data

(60) Provisional application No. 62/200,313, filed on Aug. 3, 2015.

(51) Int. Cl.
*E04F 13/08* (2006.01)
*E04F 15/02* (2006.01)

(52) U.S. Cl.
CPC .... *E04F 15/02044* (2013.01); *E04F 13/0826* (2013.01); *E04F 13/0846* (2013.01); *E04F 2015/02094* (2013.01)

(58) Field of Classification Search
CPC ..... E04F 2201/05; E04F 2015/02094; E04F 13/0826; E04F 13/0846
See application file for complete search history.

(56) References Cited

U.S. PATENT DOCUMENTS

| | | | | |
|---|---|---|---|---|
| 5,394,667 | A * | 3/1995 | Nystrom | E01D 19/125 52/263 |
| 7,409,803 | B2 * | 8/2008 | Grohman | E04B 5/12 52/489.1 |
| 7,533,500 | B2 * | 5/2009 | Morton | B29C 47/0028 52/177 |
| 7,908,812 | B2 * | 3/2011 | Eberle, III | E04F 15/04 52/489.1 |
| 2005/0028473 | A1 * | 2/2005 | Grohman | E04B 5/12 52/578 |
| 2005/0257473 | A1 * | 11/2005 | Shaw | E04F 15/02 52/480 |

* cited by examiner

*Primary Examiner* — Andrew J Triggs
(74) *Attorney, Agent, or Firm* — Hunton Andrews Kurth LLP

(57) ABSTRACT

A board anchor includes flat faces that are complementary to angled flat faces of grooves of boards between which the anchor is secured by a fastener that passes through a fastener aperture of the anchor and into an angled groove face of a board and into an underlying supporting structure beneath the board.

2 Claims, 9 Drawing Sheets

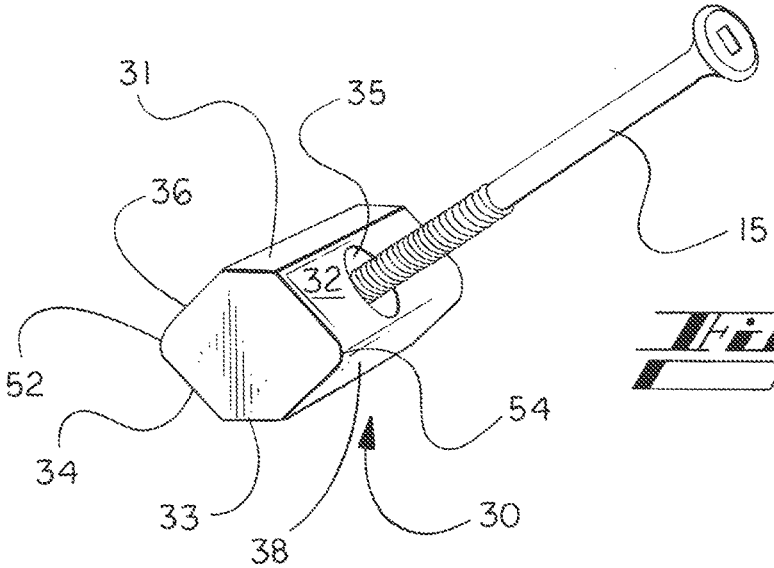
Fig. 4
Fig. 5
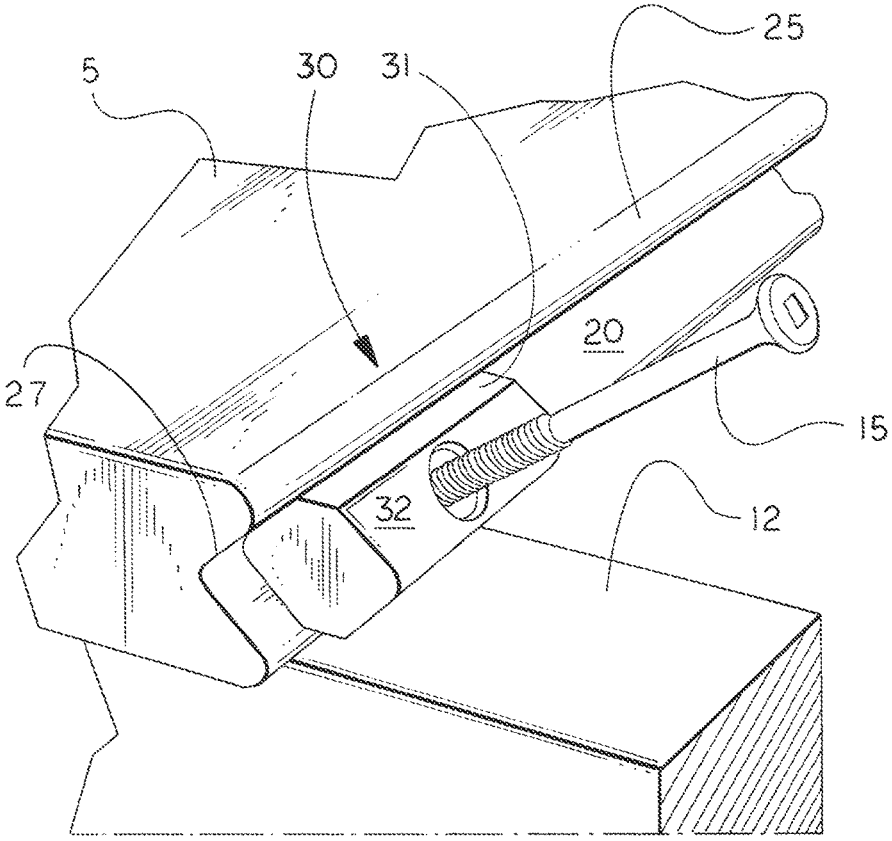

HIDDEN BOARD ANCHOR

CROSS-REFERENCE TO RELATED APPLICATIONS

This application claims the benefit of priority of U.S. Provisional Application No. 62/200,313, filed Aug. 3, 2015, which is incorporated herein by reference.

BACKGROUND OF THE INVENTION

The present invention relates to anchors for adjacent attachment of boards, such as deck boards, fence boards, flooring, panels, siding, planks and the like, to provide advantageous hiding of an anchor in a gap between boards while also aligning a fastener through an aperture in the anchor to penetrate and secure the board to a joist or other underlying structure.

Various anchoring systems for securing adjacent boards, such as decking planks, have been attempted in the prior art. As an example, U.S. Pub. No. 2005/0257473, which is incorporated herein by reference, discloses a key hole-shaped anchor with a fastener aperture for partially penetrating the plank for attachment to a joist. While such publication discloses anchors and plank grooves with shapes intended to hide the anchor (and fastener) between adjacent planks, such prior art only appreciates aligning fastener through the anchor with the fastener partially engaging the plank. Specifically, such prior art fastener is intended to pass through the prior art anchor and partially penetrate a plank while also partially penetrating a joist to which the plank is being attached.

SUMMARY OF THE INVENTION

As an improvement over the prior art hidden anchor and fastener systems with partial alignment of a fastener to the plank/board, the present invention provides an anchor with advantageous shaping and a fastener aperture for the fastener to pass through the anchor and fully penetrate the board and subsequently secure such board to a joist (or other desired underlying attachment support). The invention thus provides more secure fastening of the board to the underlying structure.

In embodiments of the present invention, an anchor includes flat faces and straight edges, including polyhedrons and partial polyhedrons, and is provided in combination with a board having a side with groove having a shape with an angled flat face complementary to a flat face of the anchor that includes an exit hole of the fastener aperture, to provide improved attachment and improved hiding of an anchor and fastener with desired gapping distance (including very minimal gaps) between adjacent boards.

BRIEF DESCRIPTION OF THE DRAWINGS

FIG. 4 is a perspective view of an anchor and fastener in one embodiment of the present invention.

FIG. 5 is a perspective view of a fastener being inserted into an anchor fastener entry hole during initial installation of a decking board in one embodiment of the present invention.

DETAILED DESCRIPTION OF THE INVENTION

Figure 1:
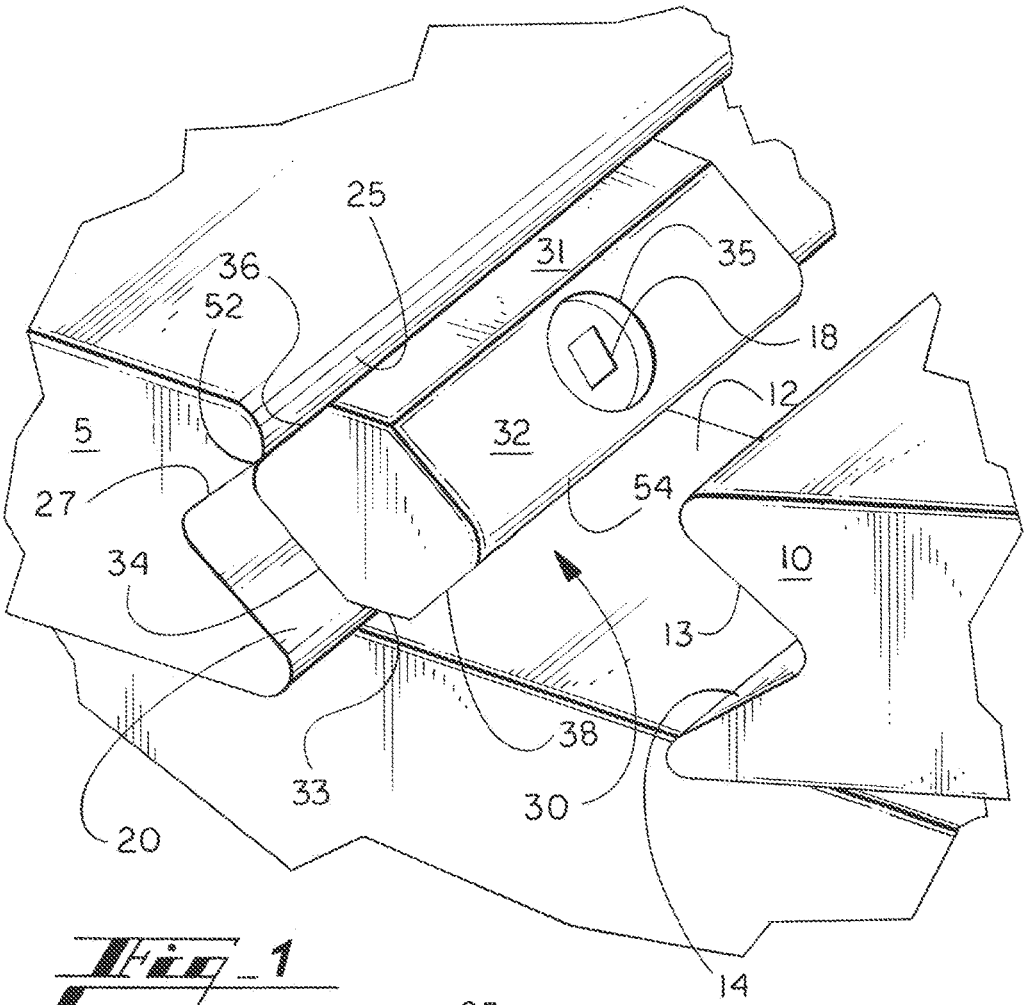
FIG. 1 is a perspective view of an anchor fastened to a decking board and an underlying joist in one embodiment of the present invention.
Figure 2:
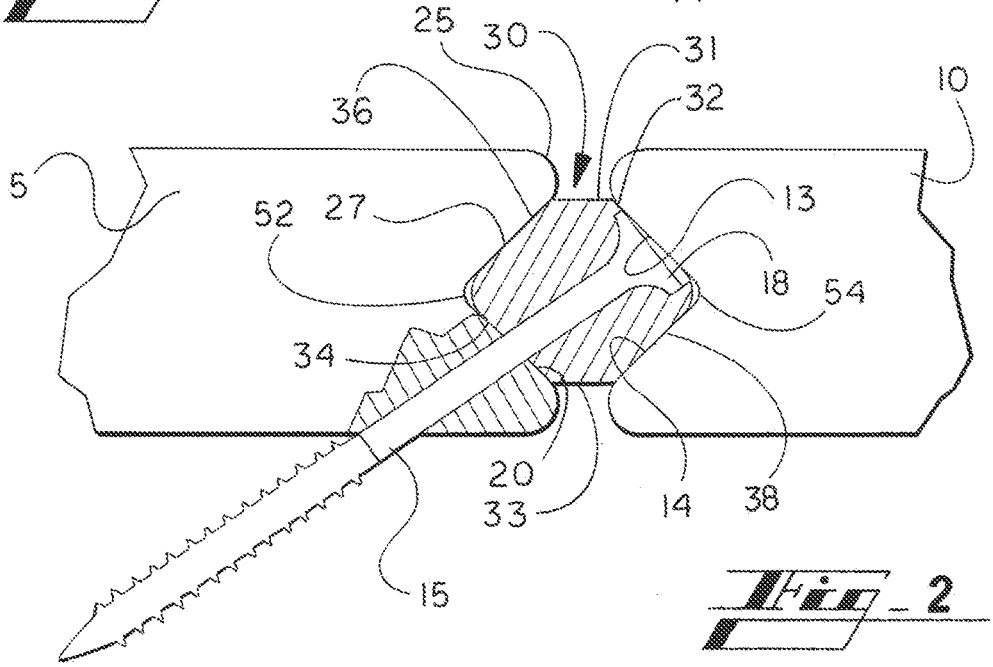
FIG. 2 is a schematic cross-sectional view of an anchor of FIG. 6 fastened with a fastener between adjacent decking boards in one embodiment of the present invention.

Referring to FIGS. 1-8, an anchor 30 in embodiments of the invention has a partial polyhedron shape, such as exemplary embodiments that are shown to include both flat faces, straight vertices, and rounded portions. As shown in FIGS. 1-3, 5, 6, 7E and 8E, an anchor 30 is secured between adjacent first decking board 5 and second decking board 10. It will be appreciated that in other embodiments an anchor 30 may similarly be used with planks, fence boards, panels, siding, flooring and other adjacent board-type installation materials (generally referred to as "boards" herein). A fastener 15 inserts through an anchor 30 and through a board, such as decking board 5, and into an underlying board support, such as a decking joist 12.

Referring to FIGS. 1, 2, 4, 5, 7C, 7D, 8C and 8D, in embodiments an anchor 30 has a first "entry hole" flat face 32 including the entry hole 35 of the pre-formed fastener aperture 40 and a second "exit hole" flat face 34 having an exit hole 37 of the fastener aperture 40 and being opposite the first flat face 32 with the entry hole 35. A third upper flat "gap control" face 31 is directly adjacent the first flat face 32. Exit hole flat face 34 is intended to abut a groove sloping face 20 of board 5. In the depicted embodiments the "gap control" face 31 is adjacent to an "overhang" flat face 36 that is intended to abut a groove overhang face 27 of overhang 25 of board 5. Overhang flat face 36 is joined to exit hole flat face 34 by a rounded portion 52 shaped to fit board 5 where board overhang face 27 and sloping face 20 meet. Opposite overhang flat face 36 is a flat face 38 that is intended to abut a groove sloping face 14 of board 10. Entry hole face 32 is joined to flat face 38 by a rounded portion 54 (opposite rounded portion 52) shaped to fit board 10 in a groove where an overhang face 13 and sloping face 14 meet.

In the embodiments shown in FIGS. 1-6, anchor 30 includes a bottom flat face 33 that is opposite gap control flat face 31 and situated between faces 34 and 38. In alternative embodiments shown in FIGS. 7A-8E, anchor 30 does not include flat face 33 and faces 34 and 38 instead meet at a corner edge 55 that is opposite face 31.

The present invention provides improved and hidden coupling of an anchor 30 to a board 5 and a smaller and less noticeable gap between boards as flat faces 34, 36, 32 and 38 abut respective complementary board groove flat faces 20, 27, 13 and 14. The fastener aperture 40 is aligned with a sloping groove face 20 of board 5 to provide the fastener 15 passing through the aperture 40 full engagement with the board, i.e, the penetrating fastener 15 is completely surrounded by the board material. Such fastener 15 thereby completely penetrates the board 5 and secures the board 5 to an underlying joist 12 (or similar underlying structural attachment). As a result, the configuration of the faces of anchor 30 and complementary board faces provide improved coupling between anchors 30, boards 5 and 10 and joists 12 (or similar underlying attachments) and also provide improved hiding of anchors 30 and fasteners 15 beneath a controlled gap distance of adjacent boards.

Figure 3:
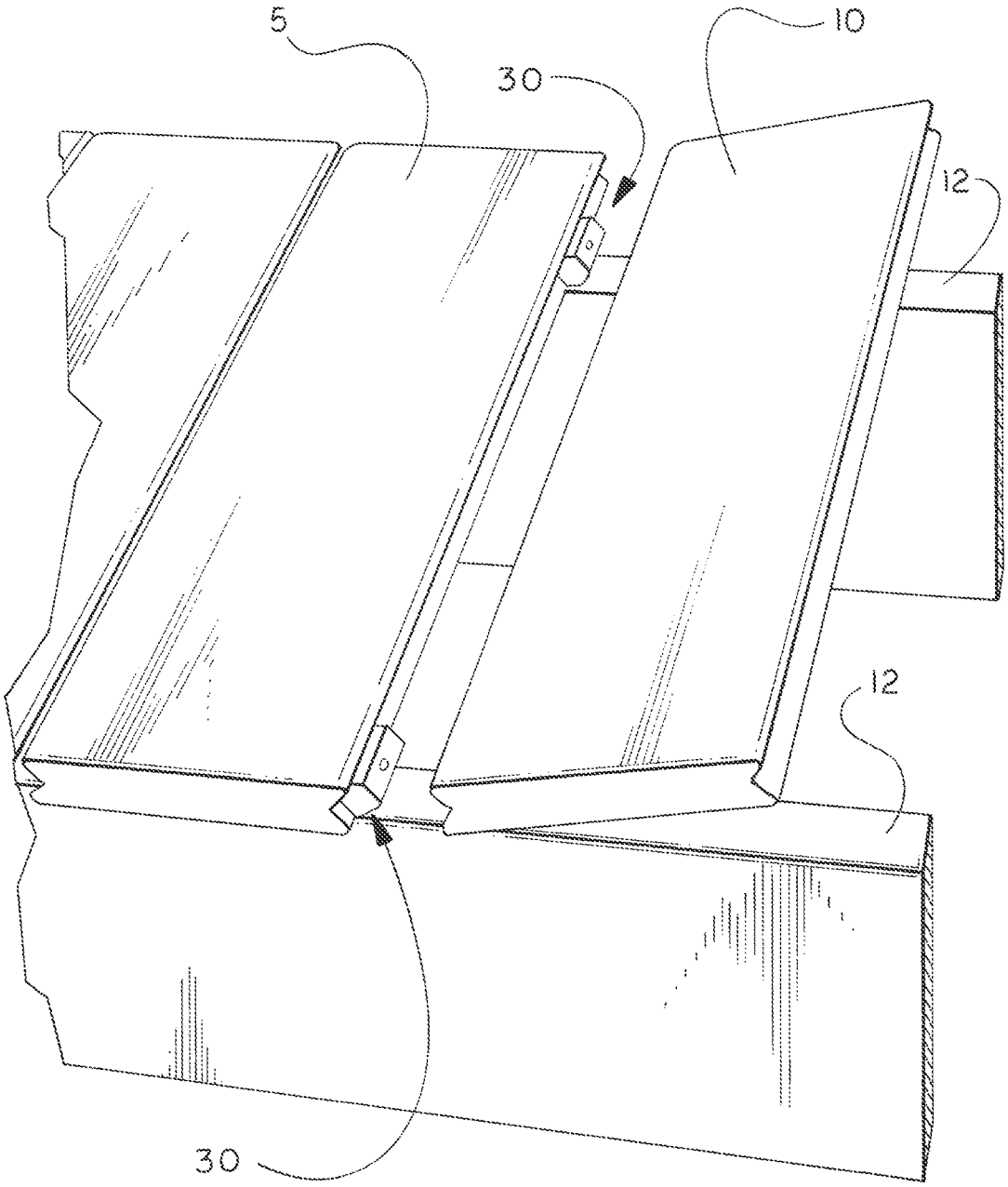
FIG. 3 is a perspective view of two anchors fastened to a first decking board during placement of a second decking board adjacent to the first decking board in one embodiment of the present invention.
Figure 6:
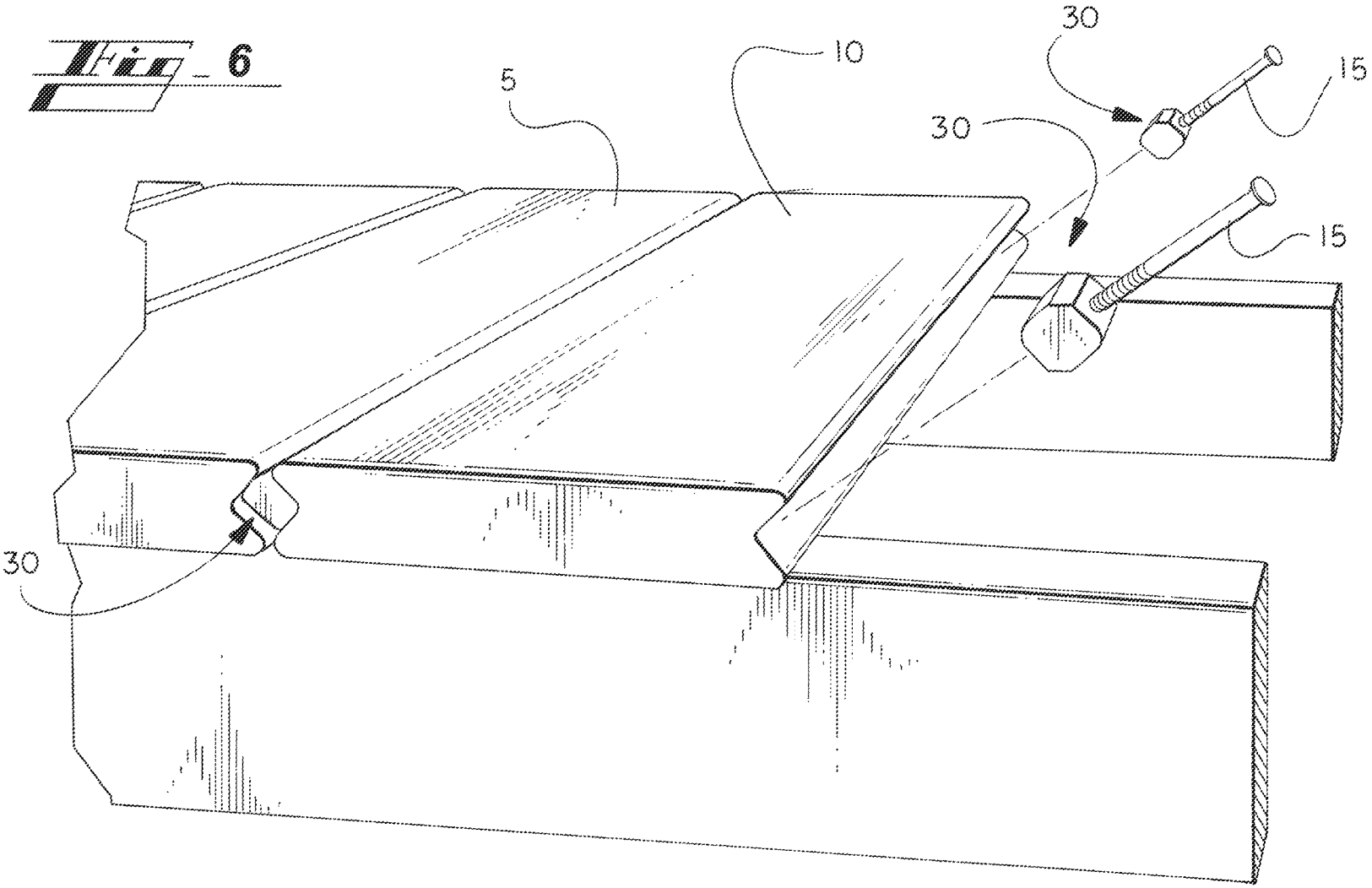
FIG. 6 is perspective view of adjacent first and second decking boards with anchors installed in a gap between the first second boards and shown with an additional pair of anchors to be placed in an exposed groove face of the second board in one embodiment of the present invention.

Referring to FIGS. 3 and 6, in exemplary embodiments multiple anchors 30 are used in the installation of each board, such as a pair of anchors 30 and fasteners 15, to optimally secure a board 5. It will be appreciated that each subsequently installed board (until the last board in a row or column of the covering installation is reached), such as board 10 following board 5, is similarly secured by anchors 30 in that subsequently placed board's "open" groove. It will also be appreciated that as a subsequent board 10 is placed in an installation next to a board 5 secured by anchor 30 of the present invention, the groove sloping face 14 of placed board 10 is secured beneath anchor face 38 to secure the groove side of board 10 that is not penetrated by a fastener.

Referring again to FIGS. 7A-8E, in embodiments of the invention, fastener aperture 40 includes a recessed entry hole 35 to better receive and hide a head 18 of a fastener 15 in flat face 32. Exit hole 37 is in opposite flat face 34. A fastener 15, such as preferably a screw shown in FIG. 9, passes through the fastener aperture 40 to penetrate a desired groove face 20 of a board 5 and secure the anchor 30 to the board 5 and to a joist 12 (or similar underlying structure).

Figure 7A:
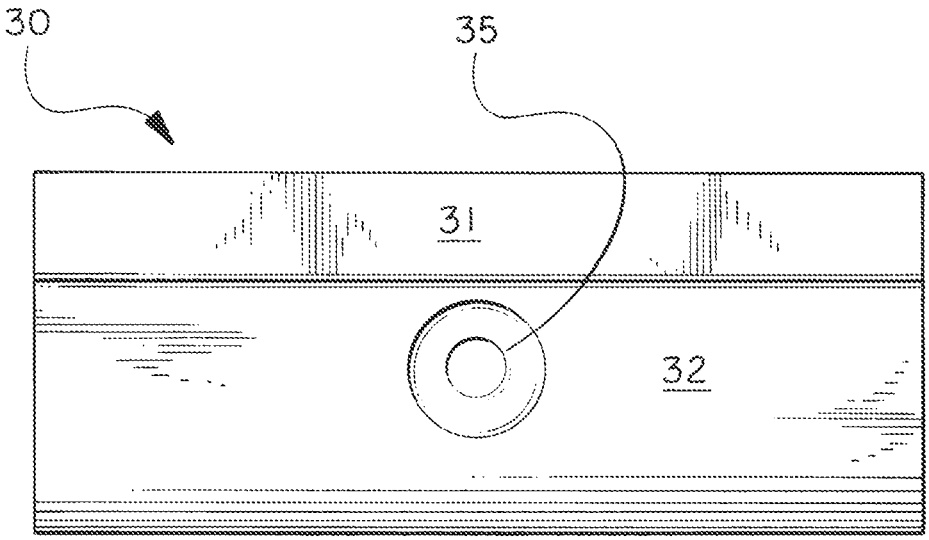
FIG. 7A is top view including the anchor fastener entry hole of an anchor of FIGS. 7A-7E in one embodiment of the present invention.
Figure 7B:
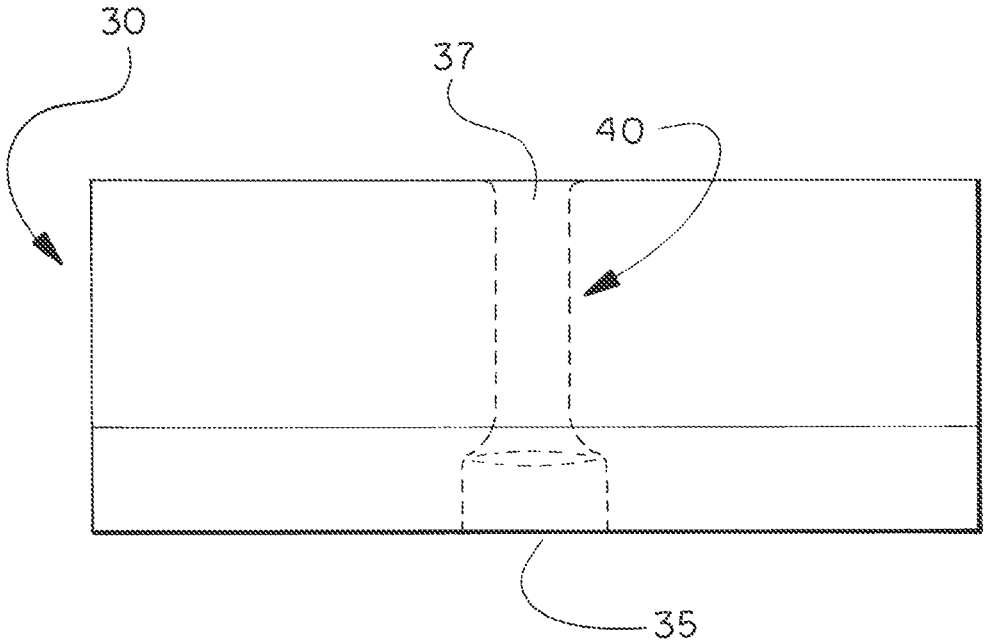
FIG. 7B is a schematic plan view of an anchor of FIGS. 7A-7E illustrating an anchor fastener hole including an entry hole and exit hole in one embodiment of the present invention.
Figure 7C:
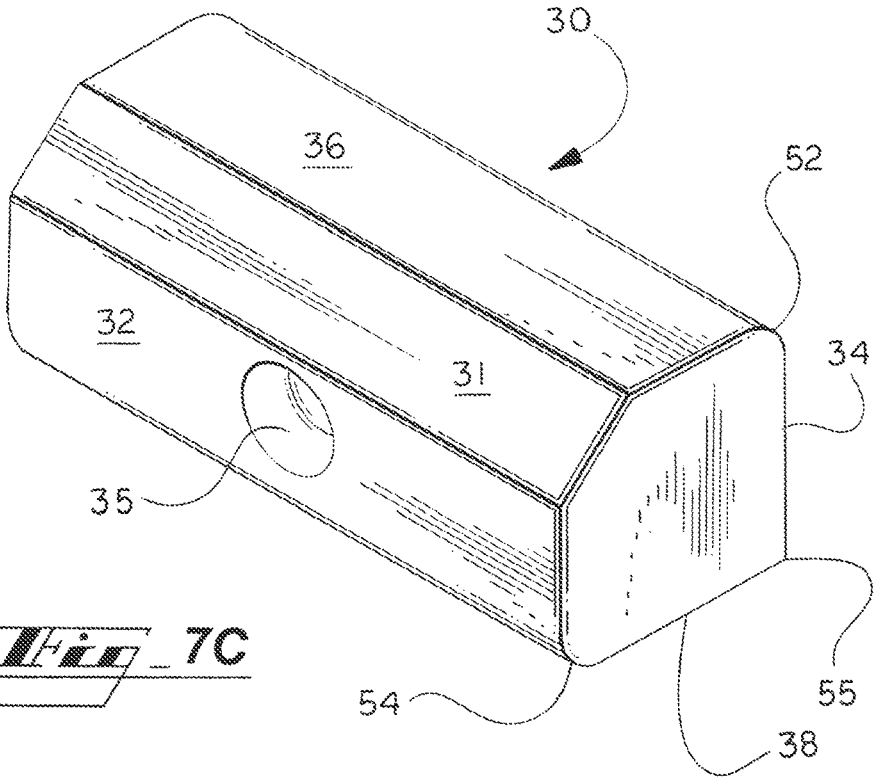
FIG. 7C is a perspective view of an anchor of an anchor of FIGS. 7A-7E in one embodiment of the present invention.
Figure 7D:
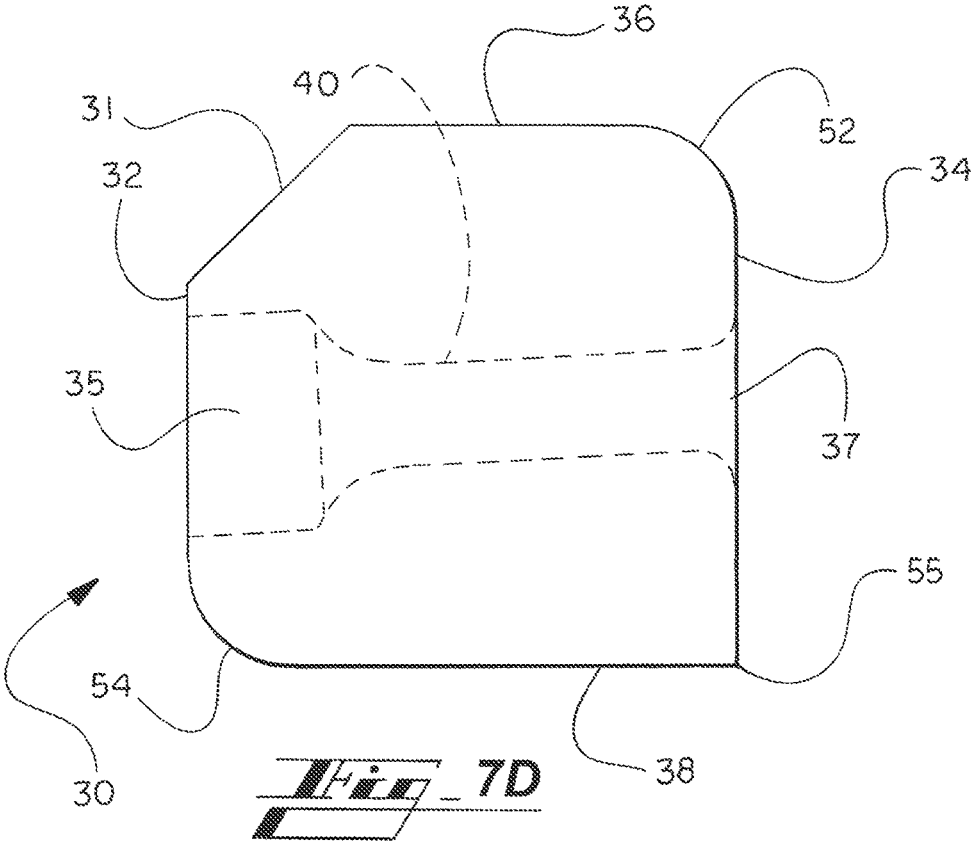
FIG. 7D is a schematic plan view of an anchor of FIGS. 7A-7E illustrating an anchor fastener hole including an entry hole and exit hole in one embodiment of the present invention.
Figure 7E:
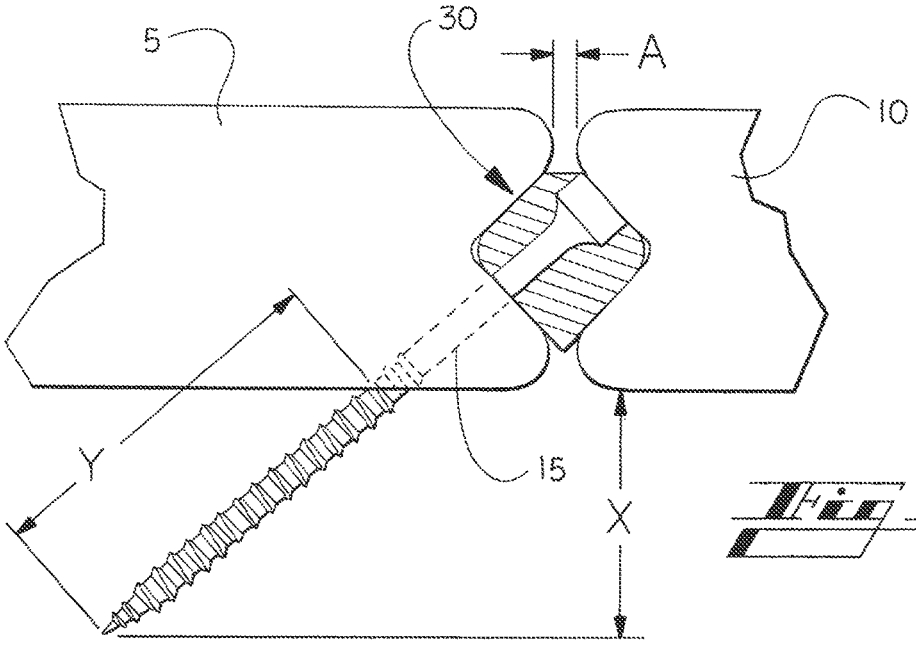
FIG. 7E is a schematic cross-sectional view of the anchor of FIGS. 7A-7D fastened with a fastener between adjacent decking boards in one embodiment of the present invention.
Figure 8E:
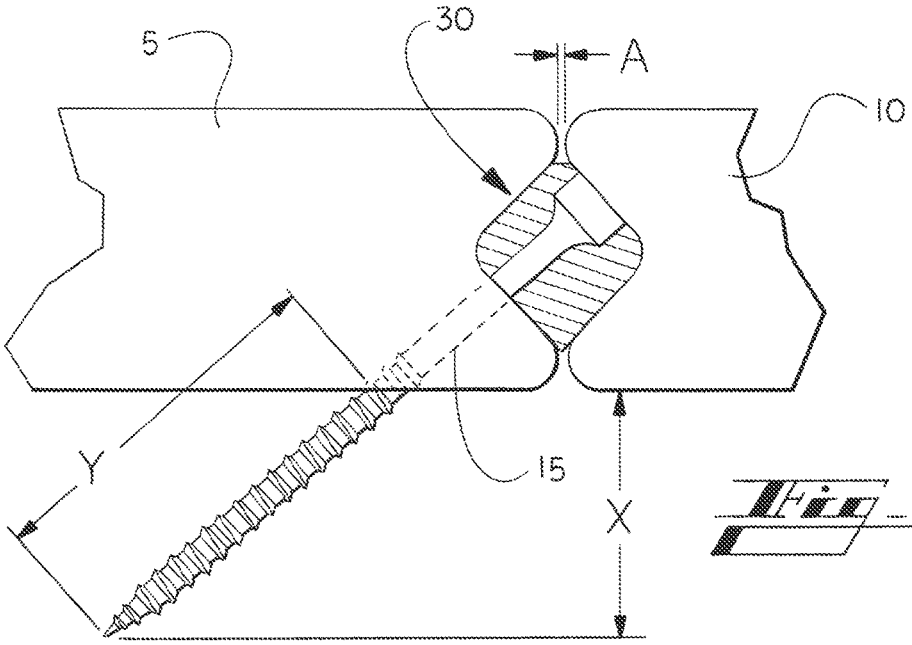
FIG. 8E is a schematic cross-sectional view of the anchor of FIGS. 8A-8D fastened with a fastener between adjacent decking boards in one embodiment of the present invention.
Figure 9:
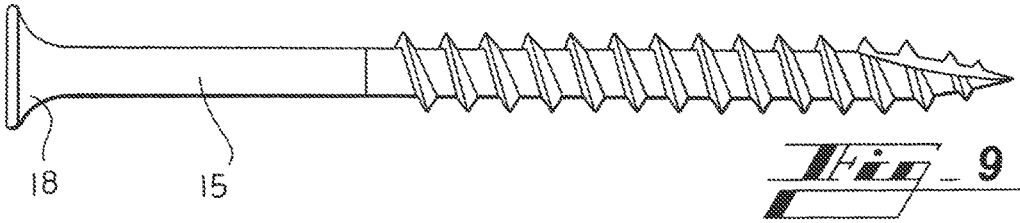
FIG. 9 is a perspective view of screw as a fastener in one embodiment of the present invention.
Figure 8A:
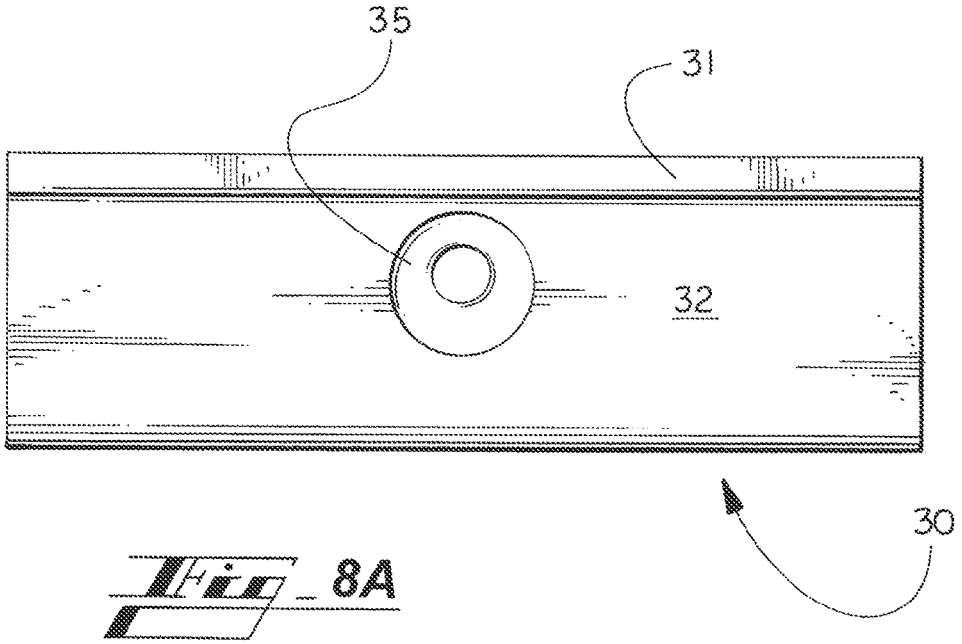
FIG. 8A is top view including the anchor fastener entry hole of an anchor of FIGS. 8A-8E in one embodiment of the present invention.
Figure 8B:
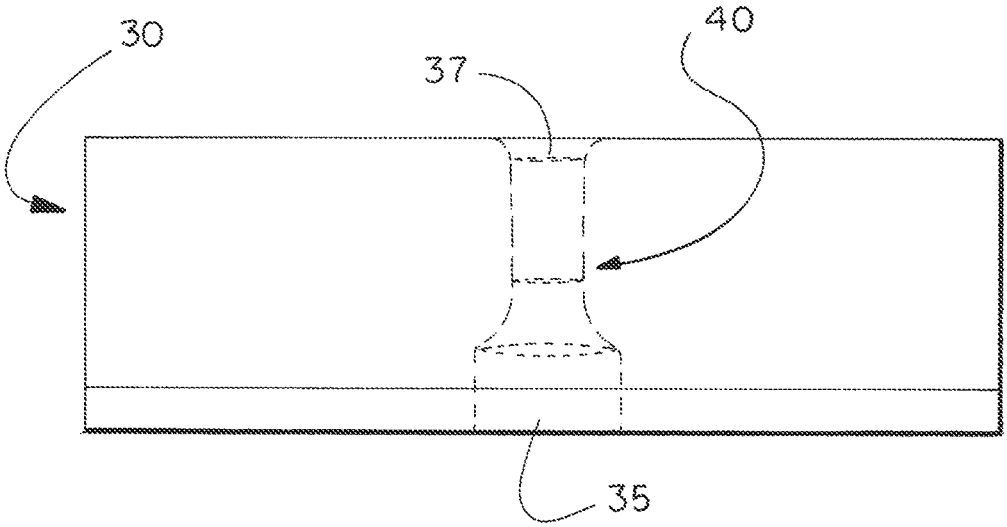
FIG. 8B is a schematic plan view of an anchor of FIGS. 8A-8E illustrating an anchor fastener hole including an entry hole and exit hole in one embodiment of the present invention.
Figure 8C:
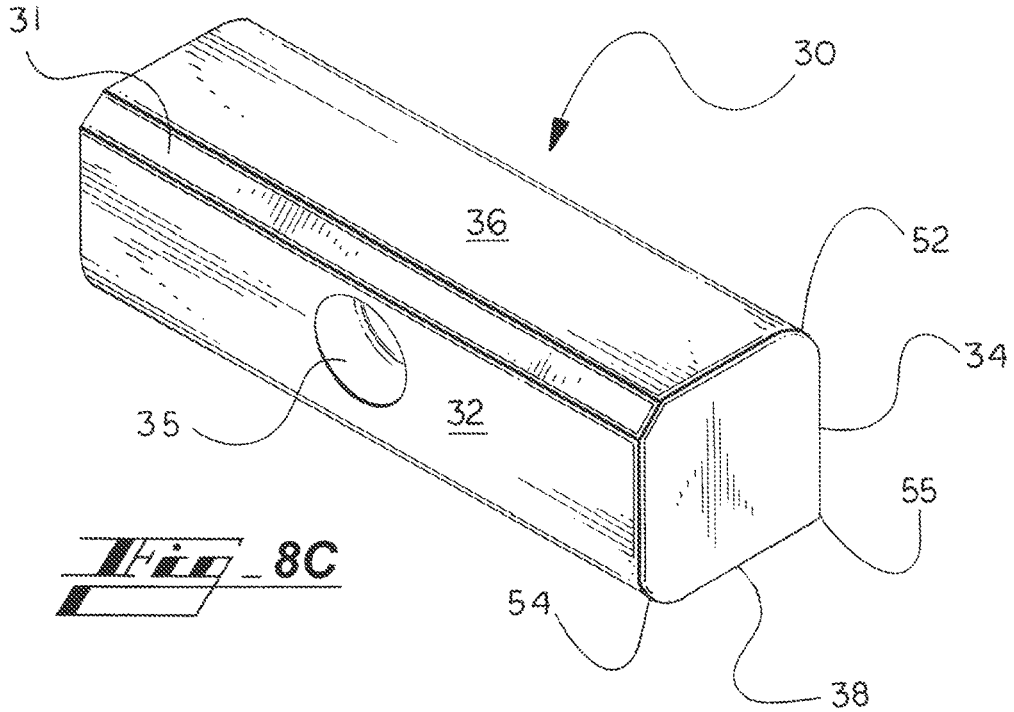
FIG. 8C is a perspective view of an anchor of an anchor of FIGS. 8A-8E in one embodiment of the present invention.
Figure 8D:
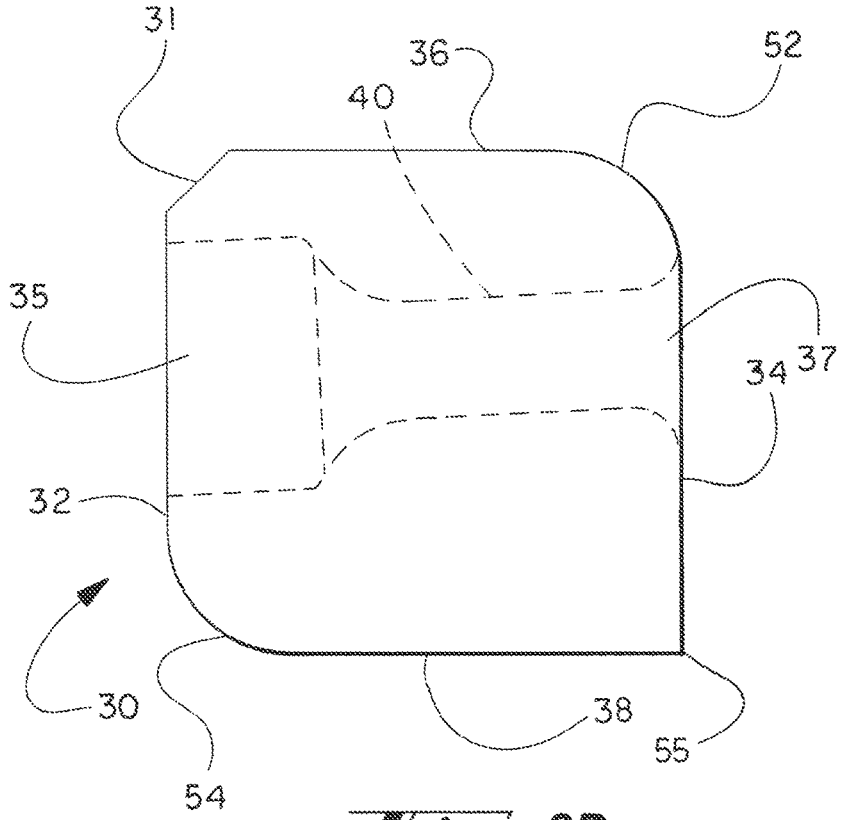
FIG. 8D is a schematic plan view of an anchor of FIGS. 8A-8E illustrating an anchor fastener hole including an entry hole and exit hole in one embodiment of the present invention.

The alternative embodiments of FIGS. 7E and 8E further illustrate that changing the widths of one or more flat faces of anchor 30 can change the gap distance A between boards 5 and 10 and alter the fastener penetration depth X and fastener penetration length Y into an underlying structure (such as joist 12). As a non-limiting example, since it will be appreciated that the dimensions of the anchor 30 may be altered as a suited to particular desired installation, use and appearance of boards, the anchor 30 shown in FIGS. 7A-7E is provided with a gap control face 31 that is 0.141 inches wide to provide a gap distance A of 0.093 inches, a fastener penetration depth X of 0.889 inches and a fastener penetration length Y of 1.281 inches.

By comparison, a smaller anchor 30 is shown in FIGS. 8A-8E with a gap control face 31 that is 0.088 inches wide and provides a smaller gap distance A of 0.019 inches, a deeper fastener penetration depth X of 0.891 inches and a longer fastener penetration length Y of 1.282 inches. In some embodiments it is preferable to control gap distance A between decking boards by providing gap control face 31 with a width of from about 0.088 inches to about 0.255 inches. In some embodiments it is preferable for the anchor 30 to have a length of about 1.5 inches.

It will be appreciated that anchors, boards, and underlying supports encompassed by the present invention may be comprised of a variety of materials, including wood, polymers (such as polyvinyl chloride, including cellular PVC, composites and metals. In embodiments of the present invention, boards are preferably cellular PVC decking boards and fasteners are steel screws.

Although fasteners are shown in embodiment of the invention as screws, it will be appreciated that nails, a wide variety of anchor screws and other fasteners may be implemented in the present invention.

Although boards used with anchors of the invention are shown in preferable embodiments as deck boards, it will be appreciated that fence boards, siding, building panels, shakes, planks, flooring, and other boards and panels may be utilized in embodiments of the invention where a hidden anchor and fastener is desirable for attachment of such structures in adjacent arrangements.

Various embodiments of the invention have been described. It will, however, be evident that various modifications and changes may be made thereto, and additional embodiments may be implemented, without departing from the broader scope of the exemplary embodiments as set forth in the claims. This specification is to be regarded in an illustrative rather than a restrictive sense.

What is claimed is:

1. A board anchor comprising:

a pre-formed fastener aperture with a recessed entry hole in a first flat face;

a second flat face opposite the first flat face and including an exit hole of the fastener aperture, wherein the first and second flat faces are in substantially parallel planes to each other, and wherein the second flat face is abutting a board groove face of a board with a fastener passing through the aperture and penetrating the board groove face;

a third flat face directly adjacent and non-perpendicular to the first flat face;

a fourth flat face opposite the third flat face; and a fifth flat face adjacent to the third flat face and a first rounded outer surface region between the fifth flat face and the second flat face and a second rounded outer surface region opposite the first rounded outer surface region and between the first flat face and a sixth flat face, wherein the sixth flat face is adjacent to the fourth flat face.

2. The board anchor of claim 1, wherein the third flat face has width from about 0.088 to about 0.255 inches.

* * * * *